US010562321B2

(12) United States Patent
Enomoto et al.

(10) Patent No.: US 10,562,321 B2
(45) Date of Patent: Feb. 18, 2020

(54) HEATING APPARATUS, IMAGE APPLIER, AND IMAGE APPLYING METHOD

(71) Applicant: Ricoh Company, Ltd., Tokyo (JP)

(72) Inventors: Tadayasu Enomoto, Kanagawa (JP); Yuuzoh Obata, Tokyo (JP); Tsuguyori Kemma, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/164,040

(22) Filed: Oct. 18, 2018

(65) Prior Publication Data

US 2019/0111710 A1 Apr. 18, 2019

(30) Foreign Application Priority Data

Oct. 18, 2017 (JP) ..... 2017-201542

(51) Int. Cl.

| | |
|---|---|
| ***B41J 3/407*** | (2006.01) |
| ***B41J 11/00*** | (2006.01) |
| ***D06P 5/30*** | (2006.01) |
| ***B41J 13/10*** | (2006.01) |
| ***B41J 11/06*** | (2006.01) |

(52) U.S. Cl.

CPC ..... *B41J 11/002* (2013.01); *B41J 3/4078* (2013.01); *B41J 11/06* (2013.01); *B41J 13/10* (2013.01); *D06P 5/30* (2013.01)

(58) Field of Classification Search

CPC ..... B41J 11/002; B41J 11/06; B41J 3/4078; B41J 13/10; D06P 5/30

See application file for complete search history.

(56) References Cited

U.S. PATENT DOCUMENTS

| | | | | |
|---|---|---|---|---|
| 2005/0179708 | A1* | 8/2005 | Ben-Zur | B41J 3/28 347/2 |
| 2011/0228025 | A1* | 9/2011 | Miyamoto | B41J 11/002 347/102 |
| 2016/0152845 | A1* | 6/2016 | Okada | C09D 11/32 347/86 |
| 2018/0105979 | A1* | 4/2018 | Matsumoto | D06P 5/2066 |
| 2018/0217536 | A1 | 8/2018 | Obata et al. | |

FOREIGN PATENT DOCUMENTS

| | | |
|---|---|---|
| JP | 2002-84084 | 3/2002 |
| JP | 2015-183331 | 10/2015 |
| JP | 2015-218418 | 12/2015 |
| JP | 2018-84013 | 5/2018 |

* cited by examiner

*Primary Examiner* — Yaovi M Ameh
(74) *Attorney, Agent, or Firm* — Xsensus LLP

(57) ABSTRACT

A heating apparatus includes an apparatus body, a receiver, a heating device, and a partition. The receiver holds a heating target so that the heating target is insertable into and removable from the apparatus body. The heating device is disposed above the receiver, to heat the heating target. The partition partitions an upper space above the heating device into a first space facing the heating device and a second space facing an upper surface portion of the apparatus body.

20 Claims, 14 Drawing Sheets

HEATING APPARATUS, IMAGE APPLIER, AND IMAGE APPLYING METHOD

CROSS-REFERENCE TO RELATED APPLICATION

This patent application is based on and claims priority pursuant to 35 U.S.C. § 119(a) to Japanese Patent Application No. 2017-201542, filed on Oct. 18, 2017 in the Japan Patent Office, the entire disclosure of which is hereby incorporated by reference herein.

BACKGROUND

Technical Field

Aspects of the present disclosure relate to a heating apparatus, an image applier, and an image applying method.

Related Art

A textile printer is known that includes a pretreatment agent coating unit to coat a pretreatment agent to a textile printing medium, a pressing unit to compress the textile printing medium coated with the pretreatment agent while heating the textile printing medium, a printing liquid discharging unit to discharge printing liquid onto the textile printing medium compressed and heated by the pressing unit, and a heater to heat the textile printing medium with the printing liquid discharged. The textile printer performs printing operation and heating operation (fixing operation) in parallel.

SUMMARY

In an aspect of the present disclosure, there is provided a heating apparatus includes an apparatus body, a receiver, a heating device, and a partition. The receiver holds a heating target so that the heating target is insertable into and removable from the apparatus body. The heating device is disposed above the receiver, to heat the heating target. The partition partitions an upper space above the heating device into a first space facing the heating device and a second space facing an upper surface portion of the apparatus body.

In another aspect of the present disclosure, there is provided an image applier that includes a cloth holder, a printer, and the heating apparatus. The cloth holder holds a cloth. The printer prints an image on the cloth held by the cloth holder. The heating apparatus heats the cloth on which the image has been printed by the printer, with the cloth being held by the cloth holder.

In still another aspect of the present disclosure, there is provided an image applying method that includes holding a cloth on a cloth holder, printing an image on the cloth with the cloth being held by the cloth holder, holding the cloth holder with the cloth being held by the cloth holder, and heating the cloth with the cloth holder being held on the receiver of the heating apparatus.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
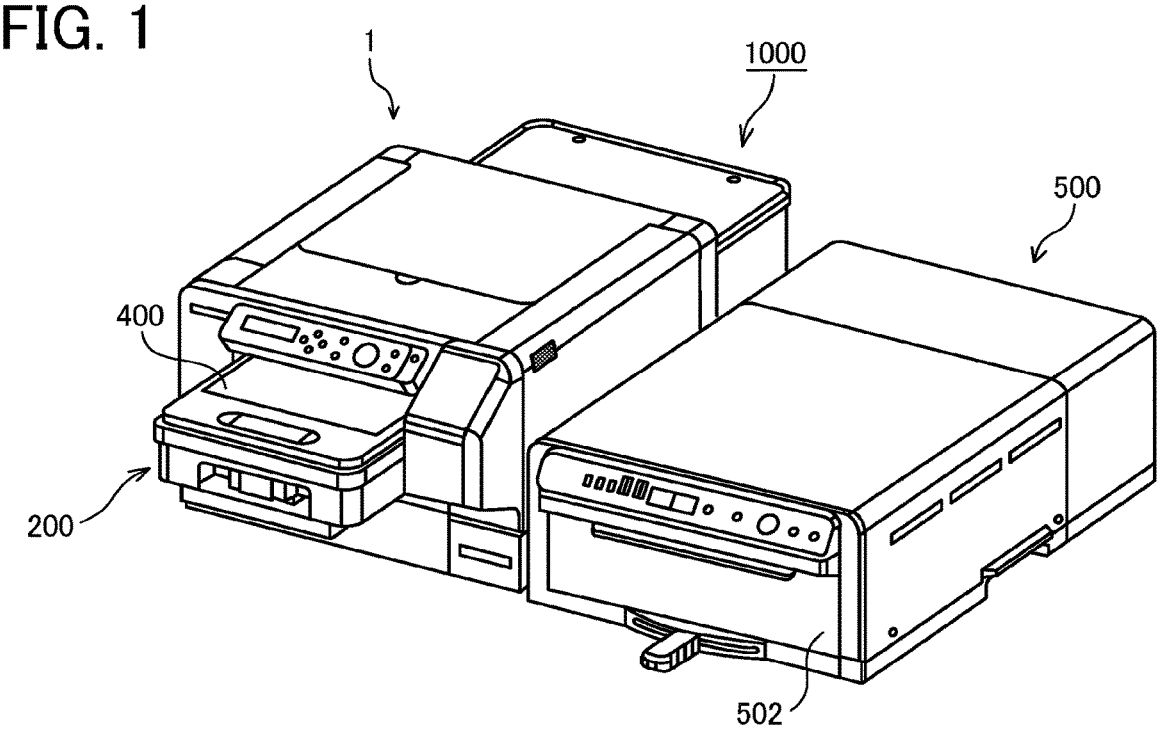
FIG. 1 is a perspective view of an example of usage of an image applier (image applying system) according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure are described with reference to the drawings. In the drawings, the same or corresponding parts are denoted by the same reference numerals, and redundant description thereof are simplified or omitted as appropriate.

Below, embodiments of the present disclosure are described with reference to the accompanying drawings. An image applier (image applying system) according to a first embodiment of the present disclosure is described with reference to FIG. 1. FIG. 1 is a perspective view of the image applier illustrating one example of usage of the image applier.

The image applier (image applying system) 1000 of FIG. 1 includes a cassette 200, a printer 1, and a heating apparatus 500 according to the present embodiment. The cassette 200 is attachable to and detachable from the printer 1, and the printer 1 prints an image on a cloth 400 that is also a printing target (a member to be printed) held by the cassette 200. The heating apparatus 500 can removably accommodate the cassette 200. The heating apparatus 500 accommodates the cassette 200 holding the cloth 400 and heats the cloth 400 to fix an image on the cloth 400.

The printer 1 and the heating apparatus 500 of the image applier 1000 are separate bodies and can be used in a form in which the printer 1 and the heating apparatus 500 are arranged side by side or in a form in which the printer 1 and the heating apparatus 500 are stacked one on the other. In some embodiments, the printer 1 may be spaced apart from the heating apparatus 500. If the printer 1 is stacked on the heating apparatus 500 or the heating apparatus 500 is stacked on the printer 1, the image applier 1000 decreases the area occupied by the printer 1 and the heating apparatus 500.

In order to cause the image applier 1000 to apply an image to the cloth 400, the user sets or attaches the cassette 200 to a stage 111 inside the printer 1 so that the printer 1 prints the image on the cloth 400.

When the printer 1 finishes printing the image on the cloth 400, the user removes the cassette 200 mounting the cloth 400 from the printer 1. The user opens a front door (front cover) 502 that is a door member of the heating apparatus 500 and accommodates the cassette 200 holding the printed cloth 400 in the heating apparatus 500. The user then closes the front door 502 and heats the cloth 400 together with the cassette 200 by the heating apparatus 500. As the heating apparatus 500 heats the cloth 400, the heating apparatus 500 fixes the image printed on the cloth 400.

In other words, the step of holding the cloth 400, to which an image is to be applied, in the cassette 200 being a cloth holder, the step of printing the image on the cloth 400 with the cloth 400 held on the cassette 200, and the step of holding the cassette 200 holding the cloth 400 in a receiver 503 (see FIG. 9) of the heating apparatus 500 according to the present embodiment and heating the cloth 400 are performed to form the image on the cloth 400.

Thus, the cassette 200 serving as a cloth holder is used in both the printer 1 and the heating apparatus 500. Such a configuration allows the cassette 200 to be set in the heating apparatus 500 while holding the printed cloth 400 in the same state as when the image is printed on the printed cloth 400. Even if the user carries the cassette 200 mounting the cloth 400, the cloth 400 is immune from creasing or partial overlapping that might degrade the print face of the cloth 400, enhancing the operability for the user in applying the image to the cloth 400.

Figure 2:
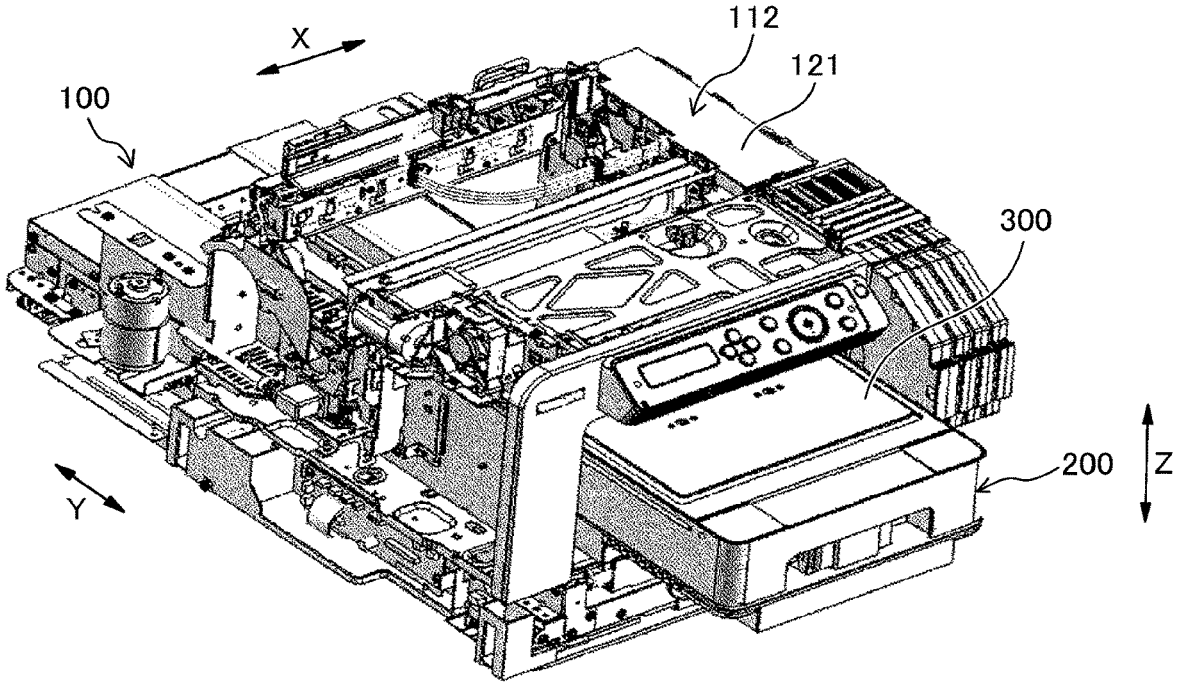
FIG. 2 is a perspective view of an example of a printer in a state in which an exterior of the printer is removed.
Figure 3A:
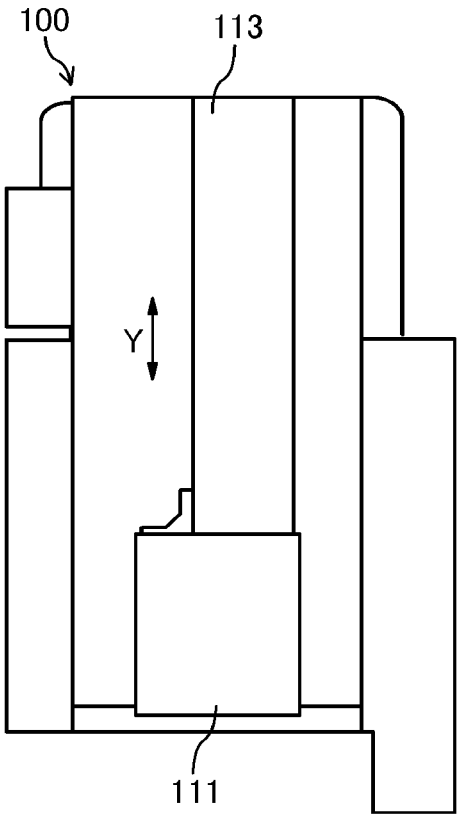
FIGS. 3A and 3B are plan views of a mechanical section of the printer below a head of the printer in a state in which a stage of the printer is at an attachment-and-detachment position.
Figure 3B:
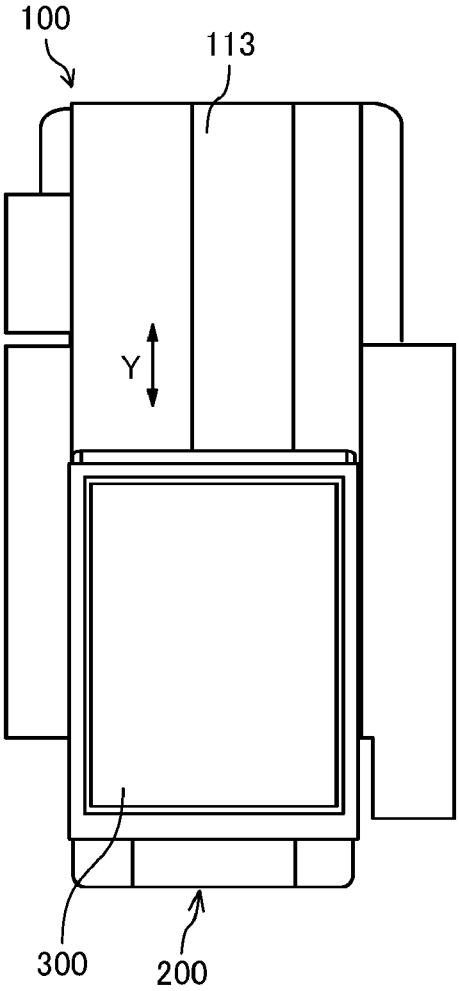
Figure 4A:
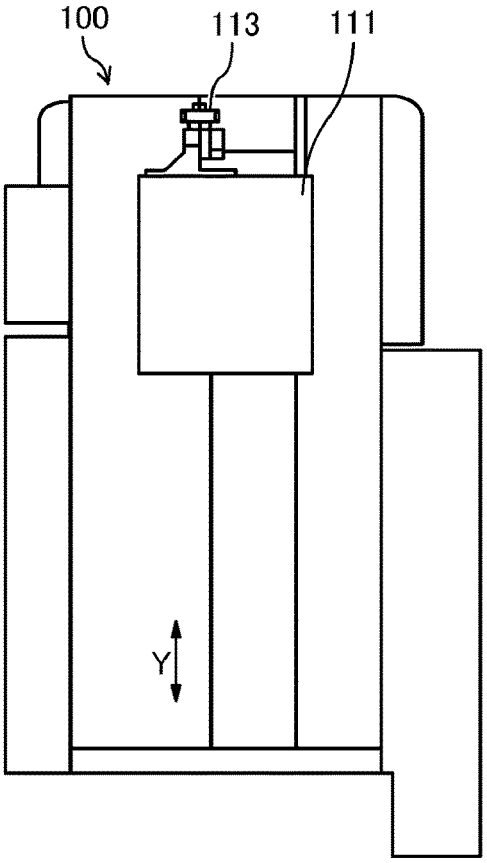
FIGS. 4A and 4B are plan views of the mechanical section below the head in a state in which the stage of the printer has moved to an innermost position.
Figure 4B:
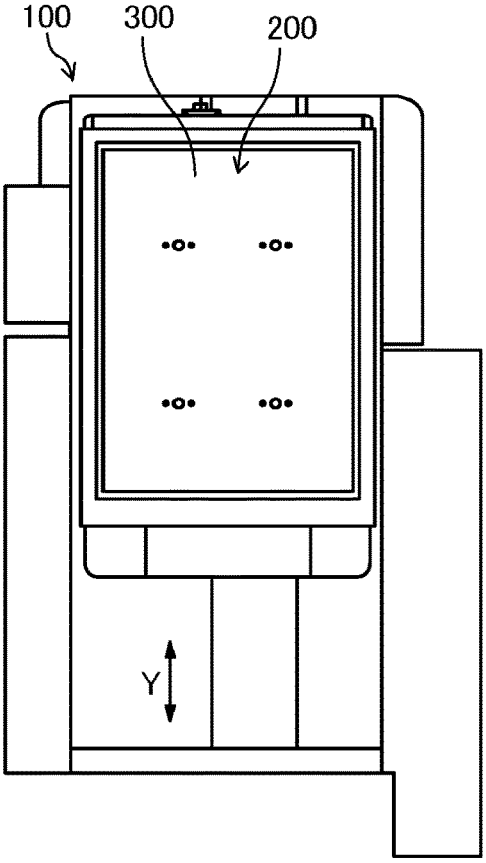

Next, an example of the printer is described with reference to FIGS. 2 to 4B. FIG. 2 is a perspective view of the printer in a state in which the exterior of the printer is removed. FIGS. 3A and 3B are plan views of a mechanical section of the printer below a head of the printer in a state in which the stage of the printer is at an attachment-and-detachment position. FIGS. 4A and 4B are plan views of the mechanical section below the head in a state in which the stage of the printer has moved to the innermost position. FIGS. 3A and 4A are illustrations of the state in which the cassette is not attached. FIGS. 3B and 4B are illustrations of the state in which the cassette is attached. Cloth held by the cassette 200 are omitted in FIGS. 3B and 4B.

The printer 1 includes the stage 111 and a printing device 112 in a body 100. The stage 111 is a receiving member to move back and forth and removably hold the cassette 200, which is a cloth holder to hold the cloth 400 also being a member to be printed. The printing device 112 performs printing on the cloth 400 held by the cassette 200, which is held by the stage 111.

The cloth 400 is, for example, a piece of cloth, such as a handkerchief or towel, a fabric manufactured as clothing, such as a T-shirt or a sweatshirt, or a fabric used as a part of a product, such as a tote bag.

The stage 111 is disposed to be movable in a direction (feed direction, which is also referred to as Y direction) indicated by arrow Y in FIGS. 3A, 3B, 4A, and 4B along the guide 113. As the stage 111 moves, the cassette 200 detachably attached to the stage 111 also moves in the Y direction.

The printing device 112 includes a carriage 121 that moves in a direction (main scanning direction, which is also referred to as X direction) indicated by arrow X with respect to the stage 111. A liquid discharge head is mounted on the carriage 121. That is, the printer 1 is an apparatus for forming an image by an inkjet recording system. Note that, in some embodiments, the printer 1 may employ any other recording system.

In the printer 1, with the cloth 400 set on a platen 300 of the cassette 200, the cassette 200 is attached and held on the stage 111 in the body 100. As the movement of the stage 111 in the Y direction and the reciprocal movement of the printing device 112 (the carriage 121) in the X direction are repeated, a desired image is printed on the cloth 400.

Here, the stage 111 can also be raised and lowered in a direction (Z direction) indicated by arrow Z in FIG. 2. The gap between the cloth 400 and the head can be adjusted to a predetermined gap by detecting the height of the surface of the cloth 400 held in the cassette 200 and raising and lowering the stage 111. That is, in printing operation, the gap between the liquid discharge head and the surface of the cloth 400 is adjusted to be constant irrespective of the thickness of the cloth 400.

In the printing operation, printing may be performed while moving the stage 111, on which the cassette 200 is attached, from the position in FIG. 3B to the position in FIG. 4B or while returning to the position in FIG. 3B after moving the stage 111 to the position in FIG. 4B.

Figure 5:
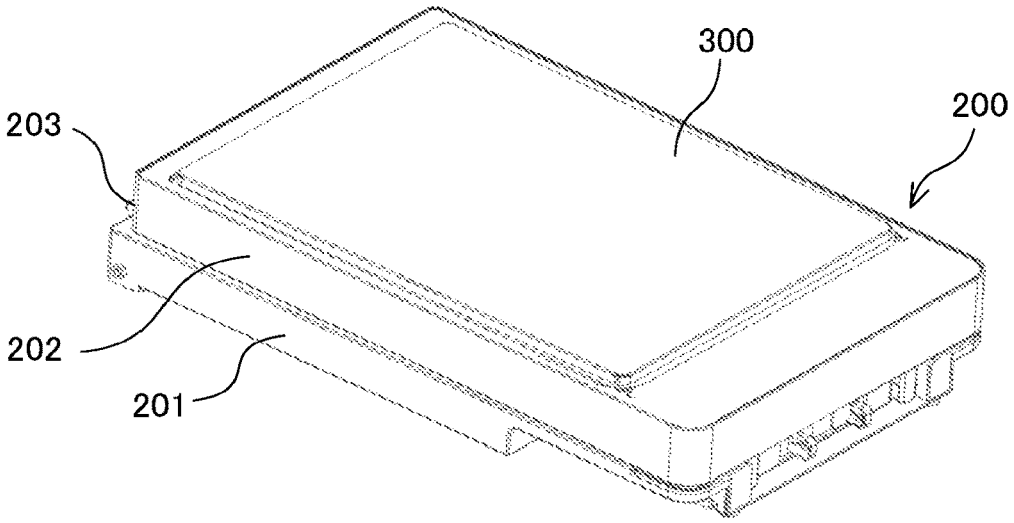
FIG. 5 is a perspective view of an example of a cassette.
Figure 6:
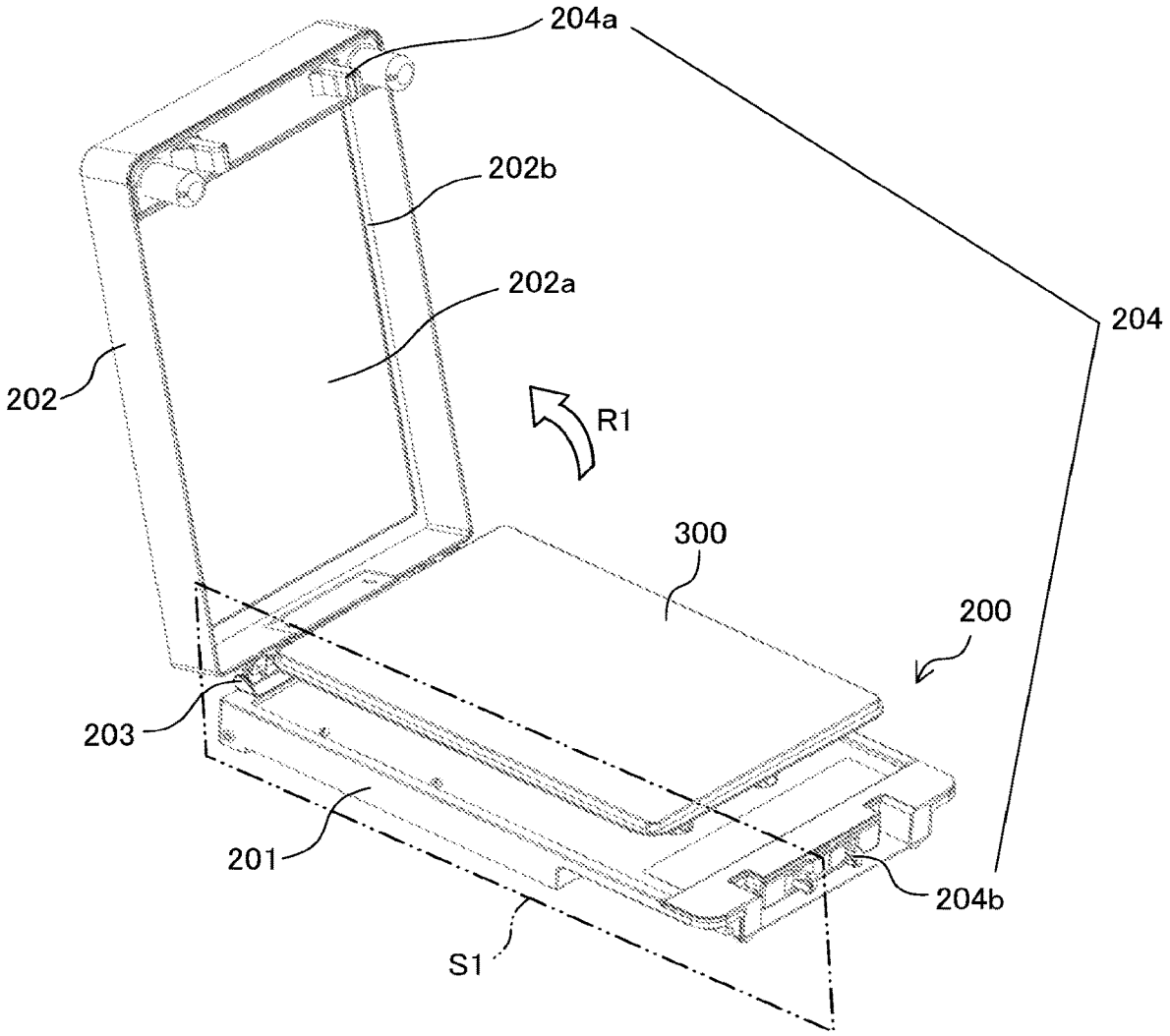
FIG. 6 is a perspective view of a state in which an outer peripheral cover of the cassette of FIG. 5 is opened.
Figure 7:
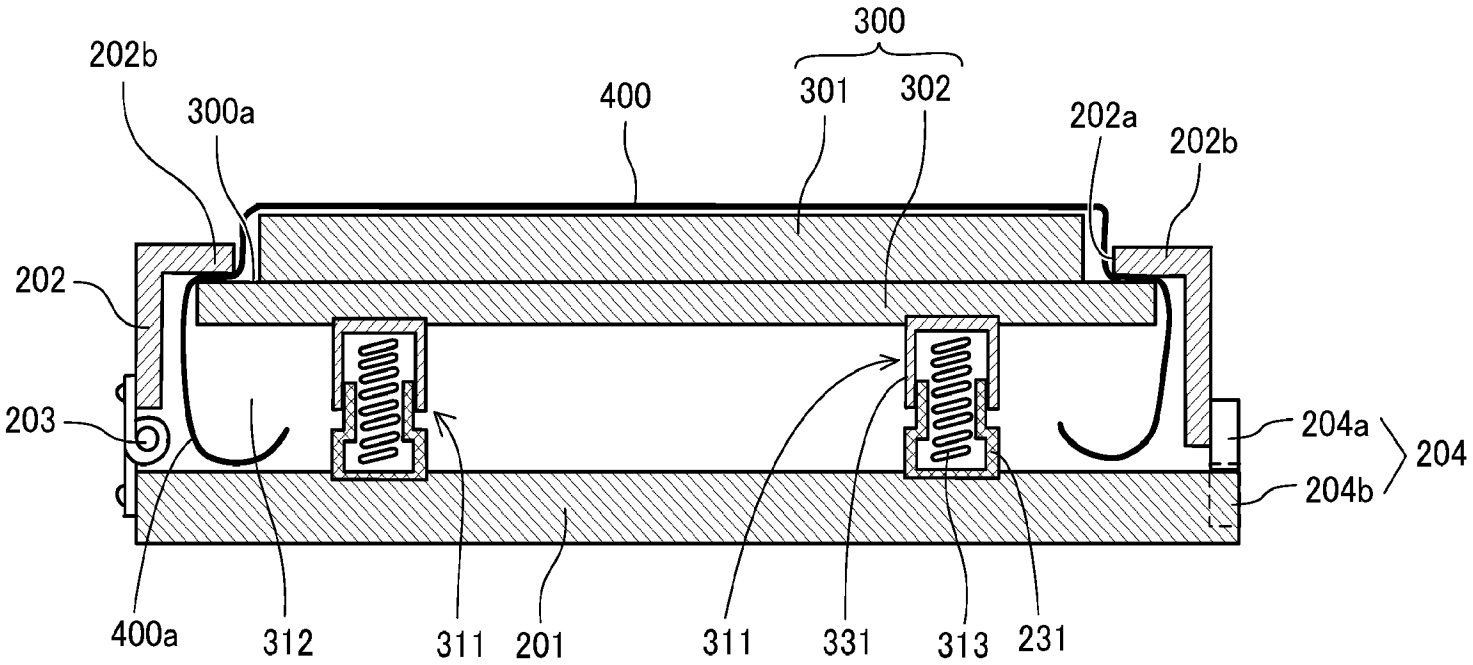
FIG. 7 is a schematic cross-sectional view of the cassette in a longitudinal direction of the cassette cut along cross-section S1 in FIG. 6.

Next, an outline of the cassette is described with reference also to FIGS. 5 to 7. FIG. 5 is a perspective view of the cassette. FIG. 6 is a perspective view of the cassette in a state in which an outer cover is opened. FIG. 7 is a schematic cross-sectional view of the cassette cut along a longitudinal direction of the cassette corresponding to a cross section on a surface S1 of FIG. 6.

The cassette 200 includes a base 201 and a platen 300 that holds a portion of the cloth 400 to be printed in a flat state.

As illustrated in FIG. 7, the platen 300 includes a platen structure 302 and a heat insulator 301. The heat insulator 301 constitutes a surface to hold the cloth 400 in a flat state. The heat insulator 301 has heat resistance against heating by the heating apparatus 500.

One end portion of an outer peripheral cover member 202 is rotatably attached to the base 201 by a hinge 203. The outer peripheral cover member 202 is openable and closable along a direction indicated by arrow R1 relative to the base 201.

The outer peripheral cover member 202 includes a frame portion 202*b* that has an opening portion 202*a* at a portion corresponding to the platen 300. The outer peripheral cover member 202 holds the cloth 400 between the frame portion 202*b* and a flange portion 300*a* being an outer peripheral portion of the platen 300.

The platen 300 is supported by supports 311 with respect to the base 201. An accommodation chamber 312 is formed between the platen 300 and the base 201 to accommodate a surplus portion 400*a* of the cloth 400. For example, when an image is printed on the front surface of a T-shirt, the surplus portion 400*a* may be a sleeve, a neck, a hem, or the like of the T-shirt.

Here, the platen 300 is detachable from the base 201 to be exchangeable with a new one. Such a configuration allows a plurality of platens 300 to be prepared so that, during printing operation, a cloth is wound around one platen 300 and another cloth is wound around another platen 300. Thus, printing of the next cloth can be promptly started by simply replacing the platen 300 after printing and fixing.

When setting the cloth 400 in the cassette 200, as illustrated in FIG. 6, the outer peripheral cover member 202 is opened to set (hold) the cloth 400 on the platen 300. At this time, as illustrated in FIG. 7, the outer peripheral cover member 202 is closed as illustrated in FIG. 5 in a state in which the surplus portion 400*a* of the cloth 400 is accommodated in the accommodating chamber 312.

When printing is performed on the cloth 400, the cassette 200 on which the cloth 400 is set is attached (set) on the stage 111 of the body 100 of the printer 1.

As described above, with the cassette 200 entirely detached from the body 100, the user can set the cloth being a print target on the platen 300, thus facilitating setting operation of the cloth 400 to the platen 300.

After the printer 1 finishes printing, the cassette 200 is set (transferred) to the heating apparatus 500 while holding the cloth 400. The cloth 400 on which the image is printed is heated and fixed by the heating apparatus 500.

In the cassette 200, the support 311 supporting the platen 300 includes a hollow columnar portion 231 on the base 201 side, a hollow columnar portion 331 on the platen 300 side, and a compression spring 313 between the hollow columnar portion 231 and the hollow columnar portion 331. The hollow columnar portion 331 is movably fitted to the hollow columnar portion 231.

Accordingly, the platen 300 is supported displaceably with respect to the base 201 being the base member.

The outer peripheral cover member 202 includes lock claws 204*a*. Each of the lock claws 204*a* is disposed on a first side of the outer peripheral cover member 202 opposite to a second side of the outer peripheral cover member 202 that is held by the hinge 203 to be openable and closable with respect to the base 201.

On the other hand, the base 201 includes lock claw holders 204*b* to hold the lock claws 204*a* or releases holding of the lock claws 204*a*.

The lock claws 204*a* and the lock claw holders 204*b* constitute at least part of locks 204 to regulate the height of the outer peripheral cover member 202 covering the peripheral portion of the platen 300 with respect to the base 201.

With such a structure, when the thickness of the cloth 400 changes, the platen 300 descends against the restoring force of the compression spring 313, the distance to the base 201 changes, and the cloth 400 having a different thickness can also be handled.

The platen 300 is continuously pressed against the outer peripheral cover member 202 with a constant force. Accordingly, even when the cassette 200 is carried, the cloth 400 is unlikely to shift.

Even when the thickness of the cloth 400 changes, the platen 300 descends to ensure a gap between the platen 300 and the outer peripheral cover member 202. Accordingly, even if the thickness of the cloth 400 is changed, the height of the outer peripheral cover member 202 with respect to the base 201 is maintained.

In other words, the height of the cloth 400 held by the platen 300 is determined based on the height of the outer peripheral cover member 202 with respect to the base 201.

Such a configuration can fix the lock position at which the outer peripheral cover member 202 is locked with respect to the base 201 by the locks 204, thus simplifying the configuration of the cassette 200. Since the lock position does not change, the user can readily operate the cassette 200.

Further, when the liquid discharge head is used for the printing device 112, image quality can be obtained with higher accuracy as the distance between the liquid discharge head and the surface of a print target to which liquid is applied is narrower.

In such a case, the platen 300 is held in a displaceable state and the peripheral portion of the platen 300 is pressed against the outer peripheral cover member 202. Accordingly, even if the thickness of the cloth 400 changes, the height of the surface of the cloth 400 is regulated by the outer peripheral cover member 202, thus enhancing image quality.

For the configuration in which the platen 300 is displaceable, the supports 311 are preferably held on the peripheral portion side of the platen 300 to secure the parallelism of the surface of the platen 300 with respect to a moving plane of the liquid discharge head of the printing device 112. However, for such a configuration, the supports 311 might hamper the accommodation chamber 312 from accommodating the surplus portion 400*a* of the cloth 400.

By contrast, by defining the height of the surface of the cloth 400 held by the platen 300 with the height of the outer peripheral cover member 202, the supports 311 can be disposed inside the platen 300. Thus, the number of the supports 311 can also be reduced. Such a configuration can readily accommodate the surplus portion 400*a* of the cloth 400 in the accommodation chamber 312.

Figure 8:
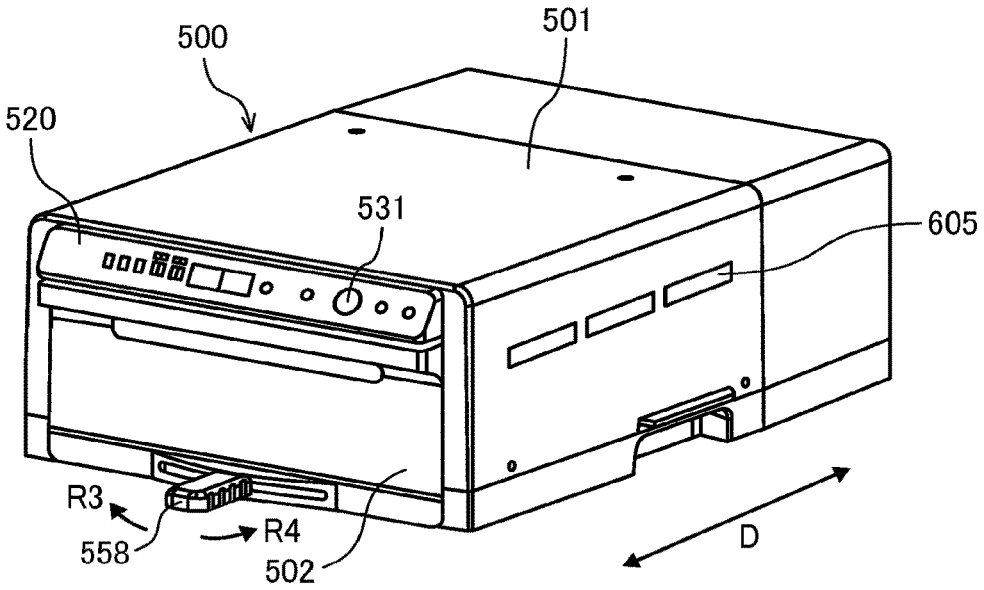
FIG. 8 is an outer perspective view of a heating apparatus according to a first embodiment of the present disclosure.
Figure 9:
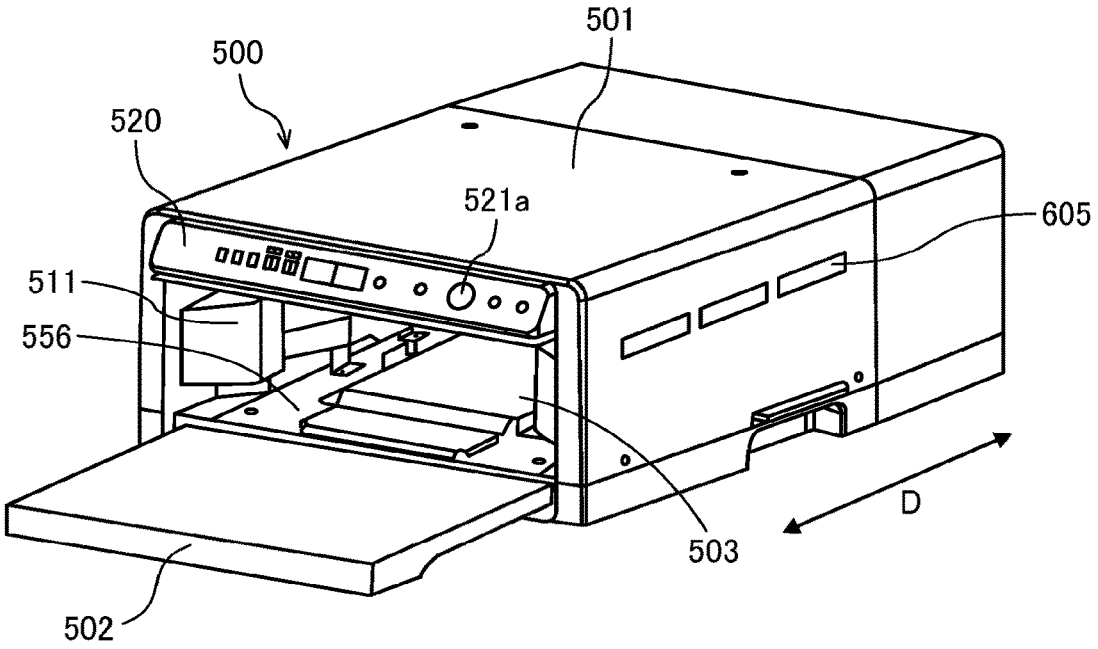
FIG. 9 is a perspective view of a state in which a front door of the heating apparatus is opened.
Figure 10:
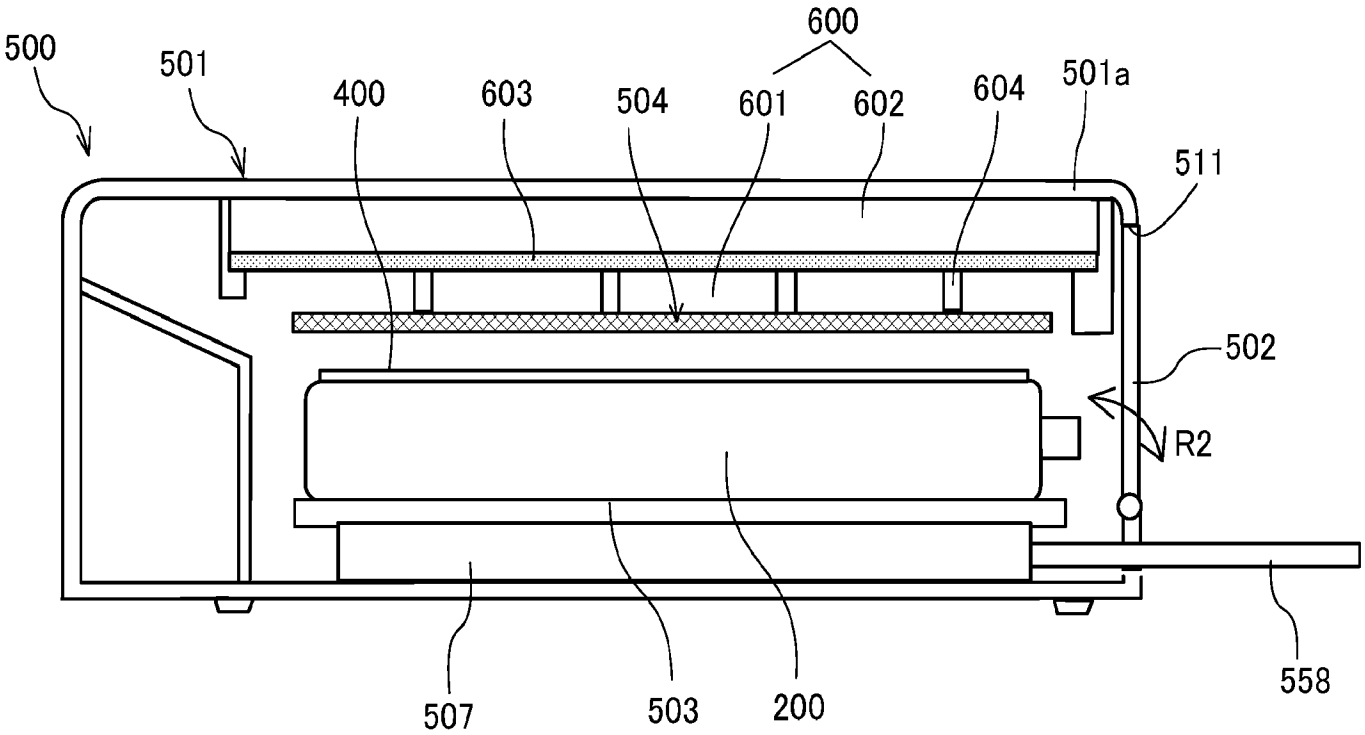
FIG. 10 is a schematic cross-sectional view of the heating apparatus cut along the longitudinal direction (cassette insertion-and-removal directions)
Figure 11A:
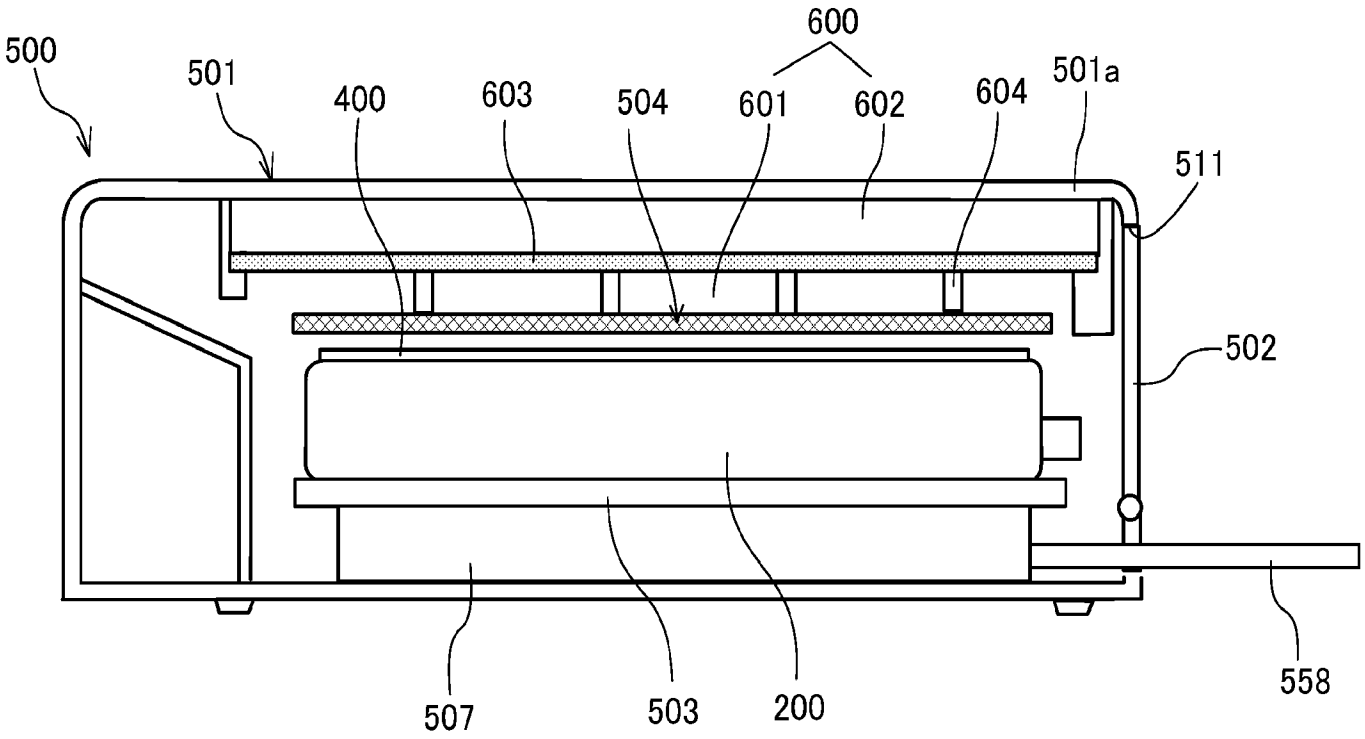
FIGS. 11A and 11B are schematic cross-sectional views of the heating apparatus cut along the longitudinal direction (cassette insertion-and-removal directions) to illustrate a usage form of the heating apparatus.
Figure 11B:
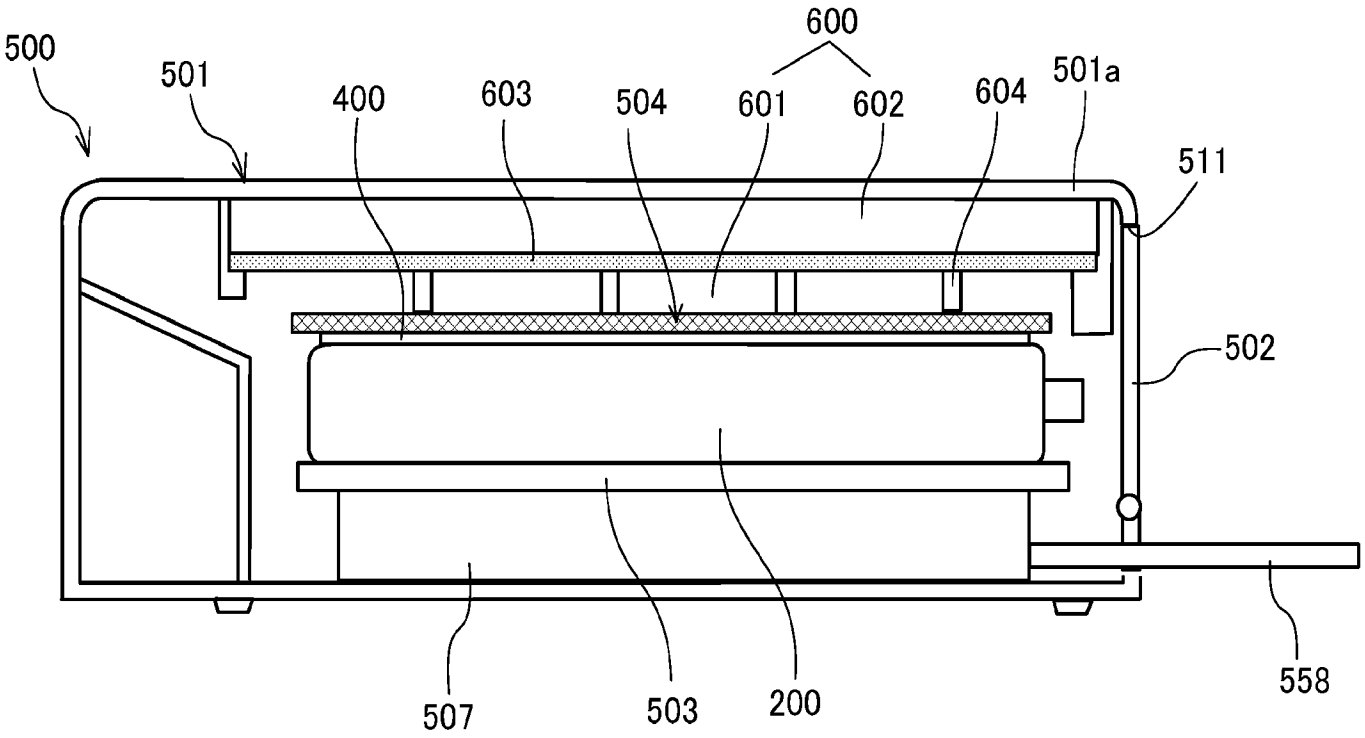
Figure 12:
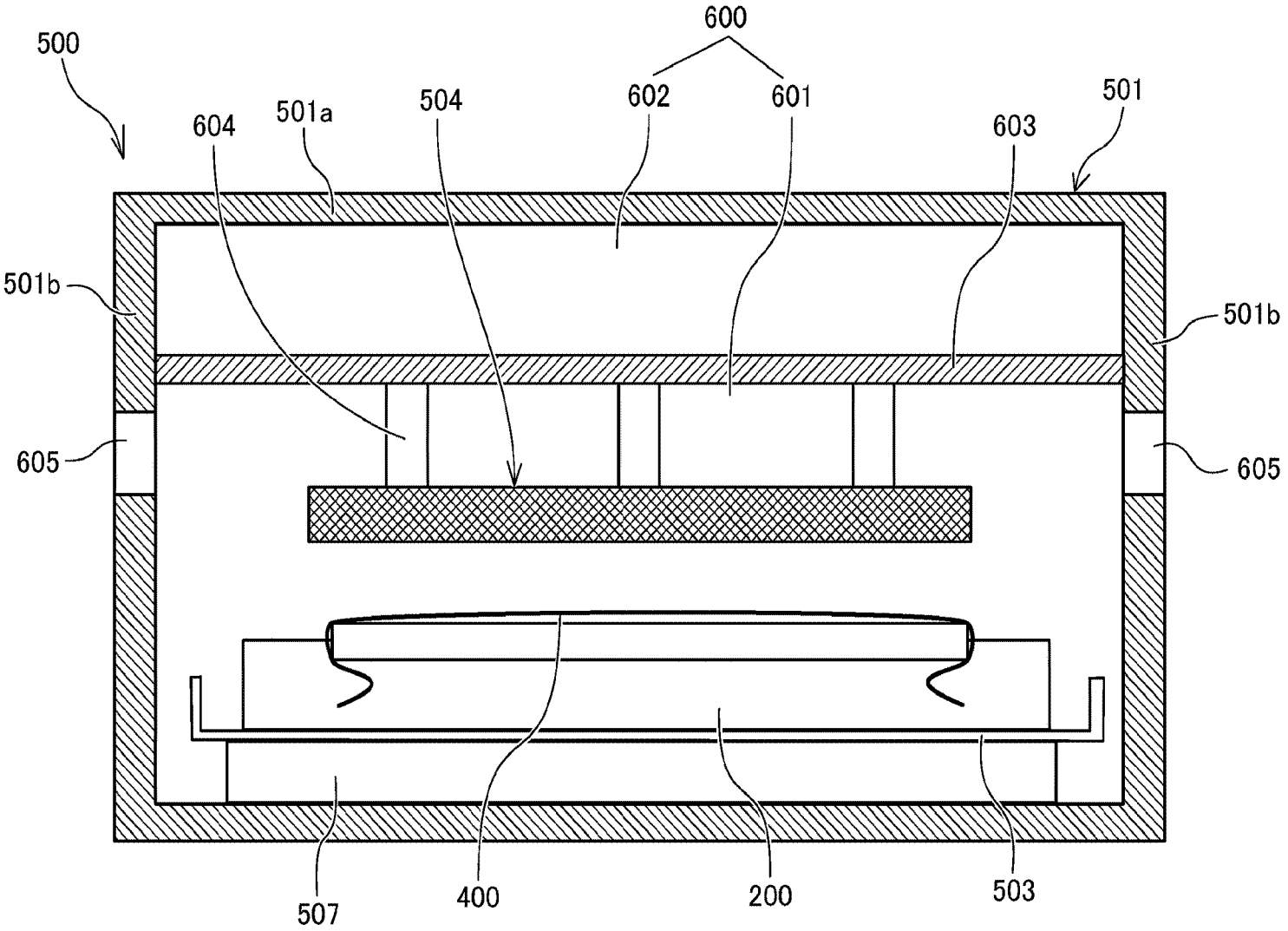
FIG. 12 is a schematic cross-sectional view of the heating apparatus in a short direction of the heating apparatus that is a direction perpendicular to the cassette insertion-and-removal directions.

Next, the heating apparatus according to a first embodiment of the present disclosure is described with reference to FIGS. 8 to 12. FIG. 8 is an outer perspective view of the heating apparatus. FIG. 9 is a perspective view of the heating apparatus in a state in which a front door of the heating apparatus is opened. FIG. 10 is a schematic cross-sectional view of the heating apparatus cut along a longitudinal direction (cassette insertion-and-removal directions indicated by arrow D) of the heating apparatus. FIGS. 11A and 11B are schematic cross-sectional views of the heating apparatus cut along the longitudinal direction (cassette insertion-and-removal directions) to illustrate a usage form of the heating apparatus. FIG. 12 is a schematic cross-sectional view of the heating apparatus in a short direction of the heating apparatus that is a direction perpendicular to the cassette insertion-and-removal directions.

In the present embodiment, the heating apparatus 500 is a heating apparatus to heat the cloth and includes an apparatus body 501 and a front door (front cover) 502. The front door 502 is disposed on the front side of the apparatus body 501, to open and close an opening 511 through which the cassette 200 is inserted into and removed from the apparatus body 501.

The front door 502 is openable and closable in the directions indicated by arrow R2 in FIG. 10 and can be opened to fall down as illustrated in FIG. 9. By opening the front door 502, the cassette 200, which is a cloth holder to hold the cloth 400 to be heated, can be inserted into or removed from the apparatus body 501 through the opening 511.

A receiver (table) 503 is disposed inside the apparatus body 501. The receiver 503 holds the cassette 200 to be insertable or removable relative to the apparatus body 501. As described above, the cassette 200 serves as a cloth holder to removably hold the cloth 400 that is a heating target.

Similarly with the stage 111 of the printer 1 illustrated in FIG. 3A, the receiver 503 is a holder to which the cassette 200 is removably attached, a table on which the cassette 200 is placed, or the like.

A heating device 504 is disposed above the receiver 503, to face the cloth 400 held by the cassette 200 and heat the cloth 400. The heating device 504 includes, for example, a heater that is a heat generator.

The surface of the heating device 504 facing the receiver 503 is configured to be positioned substantially parallel to an exposed surface of the cloth 400 held by the cassette 200 that is set on the apparatus body 501.

Note that a planar member made of a material having excellent heat conductivity, such as aluminum, is disposed on the side of the receiver 503 of the heating device 504, to heat the heating device 504 so that the surface temperature becomes substantially uniform by heat generation of the heating device 504. Such a configuration allows the cloth 400 to be heated at substantially the same temperature in the plane, regardless of the heating position.

The receiver 503 is held by a lift (position switching mechanism) 507 that is an elevating device. The receiver 503 is relatively movable in three steps in the vertical direction (a direction in which the relative distance changes) with respect to the heating device 504.

The lift 507 includes an operation lever 558 being a position switching lever. When the operation lever 558 is moved in a direction indicated by arrow R3 or R4 in FIG. 8, a holding table 556 (see FIG. 9) holding the receiver 503 moves upward or downward to move the receiver 503 up or down.

Here, the relative positions of the receiver 503 with respect to the heating device 504 include a standby position (first position) illustrated in FIG. 10, a non-contact heating position (second position) illustrated in FIG. 11A, and a contact heating position (third position) illustrated in FIG. 11B. The relative distance of the receiver 503 with respect to the heating device 504 is greatest when the receiver 503 is at the standby position and shortest when the receiver 503 is at the contact heating position at which the cloth 400 contacts the heating device 504. The relative distance of the receiver 503 at the non-contact heating position is greater than the relative distance of the receiver 503 at the contact heating position.

The standby position illustrated in FIG. 10 is a position that allows the user to insert the cassette 200 into the apparatus body 501 and remove the cassette 200 from the apparatus body 501. The non-contact heating position in FIG. 11A is a heating position at which the cloth 400 is heated by the heating device 504 without contacting the heating device 504. The contact heating position illustrated in FIG. 11B is a heating position (press position) at which the cloth 400 is heated in contact with the heating device 504.

As illustrated in FIG. 8, a plurality of keys, such as a start key 531 for instructing the start of heating, and a display are arranged on an operation panel 520.

As illustrated in FIGS. 10 and 12, a partition 603 is disposed above the heating device 504, to divide an upper space 600 of the heating device 504 into a first space 601 on the heating device 504 side and a second space 602 on the side of an upper surface portion 501*a* of the apparatus body 501. The partition 603 is made of, for example, a heat shield or a heat insulator.

Further, in the present embodiment, the heating device 504 is supported by the partition 603 via support members 604. In some embodiments, the heating device 504 may be held by the apparatus body 501.

In addition, side walls 501*b* on both sides of the apparatus body 501 include ventilation ports 605 as ventilation paths on lateral sides of the first space 601. For example, a fan may be disposed in the ventilation port 605.

In the heating apparatus 500, for example, the cassette 200 holding the cloth 400 to which liquid is applied is held by the receiver 503, and the heating device 504 generates heat to heat the cloth 400 in non-contact with the cloth 400. Note that the heating device 504 may generate heat to heat the cloth 400 in contact with the cloth 400.

Here, the heat generated from the heating device 504 heats the opposing cloth 400 and also heats the upper space 600 opposite to the cloth 400.

At this time, since the upper space 600 of the heating device 504 is partitioned into the first space 601 and the second space 602 by the partition 603, the temperature of the second space 602 on the side of the upper surface portion 501*a* of the apparatus body 501 does not immediately change due to convection while the temperature of the first space 601 on the side of the heating device 504 rises.

In such a case, some heat is transmitted to the second space 602 via the partition 603. However, since the second space 602 functions as a heat insulating portion, the temperature rise of the upper surface portion 501*a* of the apparatus body 501 is suppressed.

Further, using a heat reflecting material (heat shield) such as aluminum or the like as the partition 603 can further reduce the transfer of heat to the second space 602.

Further, since the ventilation ports 605 communicating with the outside of the apparatus body 501 is disposed at lateral sides of the first space 601, for example, air of the first space 601 whose temperature has been increased by the heating device 504 is exchanged with the outside air by natural convection.

As a result, the temperature rise of the first space 601 immediately above the heating device 504 is suppressed, and the temperature rise of the upper surface portion 501*a* and the second space 602 on the side of the upper surface portion 501*a* is also suppressed.

In addition, the ventilation ports 605 are disposed to face the first space 601 immediately above the heating device 504. Such a configuration can suppress the temperature rise of the receiver 503 side of the heating device 504 (the cloth 400 side at heating) while suppressing the temperature rise of the first space 601.

Thus, the temperature rise of the upper surface portion 501*a* of the apparatus body 501 can be suppressed without lowering the heating function.

Figure 13:
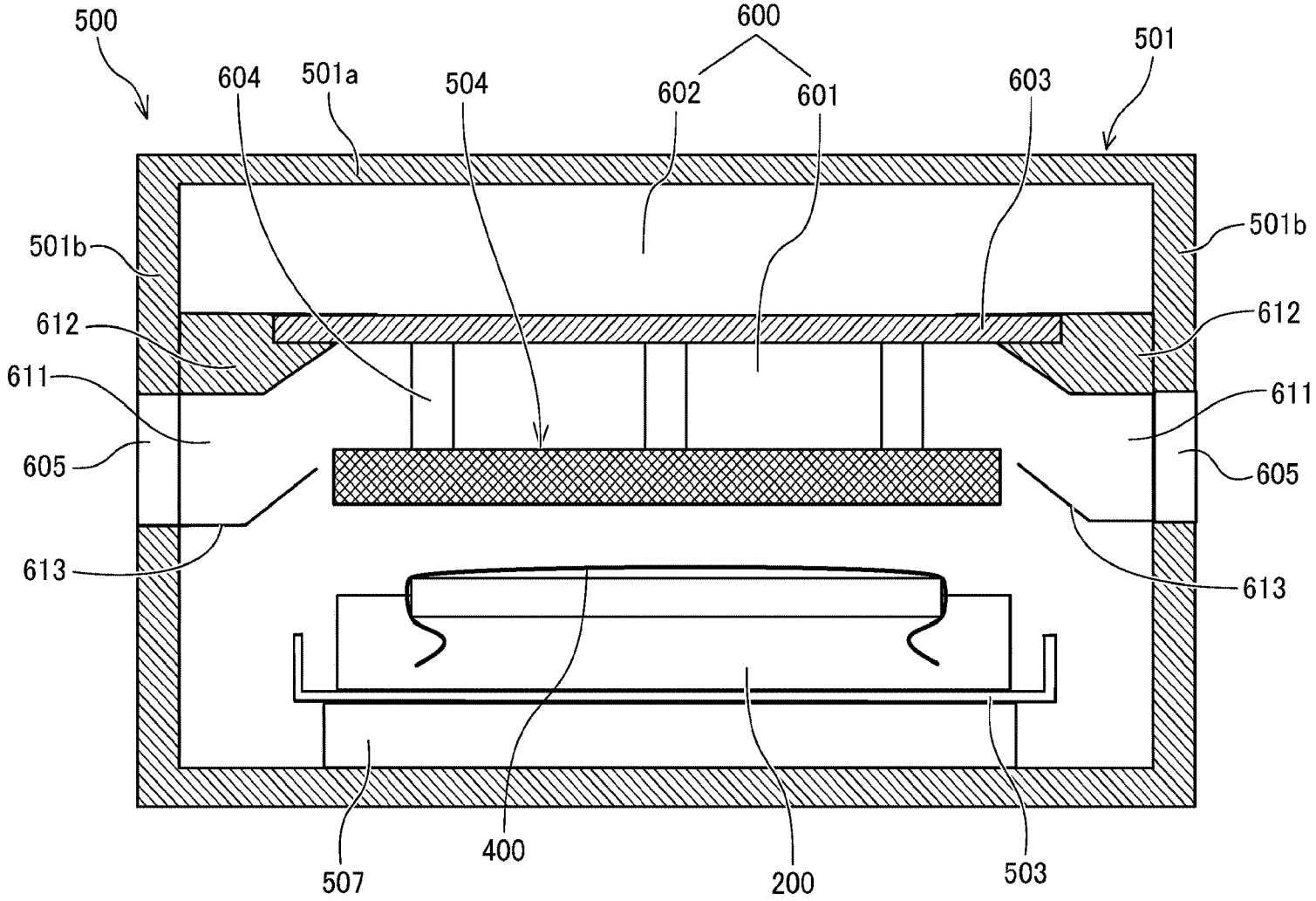
FIG. 13 is a schematic cross-sectional view of the heating apparatus according to a second embodiment of the present disclosure, cut along the short direction.

Next, the heating apparatus according to a second embodiment of the present disclosure is described with reference to FIG. 13. FIG. 13 is a schematic cross-sectional view of the heating apparatus cut along the short direction (direction perpendicular to the cassette insertion-and-removal directions).

In the present embodiment, ducts 611 connecting the first space 601 and the ventilation ports 605 are provided, and ventilation paths are formed by the ventilation ports 605 and the ducts 611. In the vertical direction, the duct 611 includes upper duct members 612 supporting the partition 603 and lower duct members 613 opposed to the upper duct members 612.

As described above, connecting the first space 601 to the ventilation ports 605 by the ducts 611 can effectively dissipate the heat of the first space 601 and further reduce a temperature fall of the receiver 503 side of the heating device 504 (the cloth 400 side at heating).

In such a case, a fan may be disposed at the ventilation port 605, and the duct 611 enhances the intake and exhaust efficiencies of the fan.

A part of the duct 611, for example, the lower duct member 613 may be formed of metal, for example, a sheet metal such as SECC (electro-galvanized steel plate). Such a configuration can more effectively release heat to the outside of the apparatus body by heat conduction of the sheet metal itself in addition to air convection, thus allowing more effective suppression of the temperature rise in the first space 601.

Figure 14:
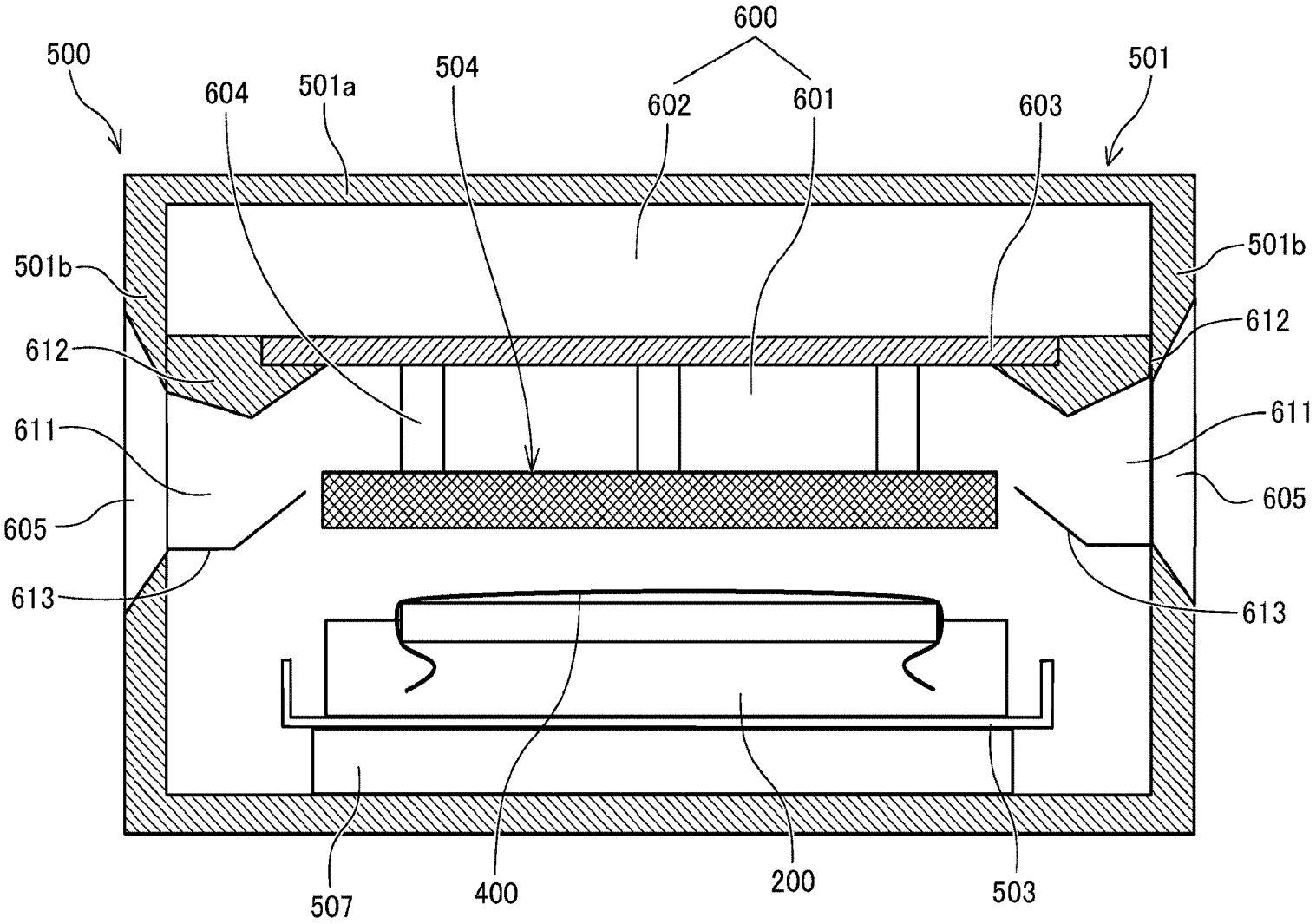
FIG. 14 is a schematic cross-sectional view of the heating apparatus according to a third embodiment of the present disclosure, cut along the short direction.

Next, the heating apparatus according to a third embodiment of the present disclosure is described with reference to FIG. 14. FIG. 14 is a schematic cross-sectional view of the heating apparatus cut along the short direction (direction perpendicular to the cassette insertion-and-removal directions).

In the present embodiment, each of the ventilation ports 605 of the apparatus body 501 has a cross-sectional shape that widens from the inside to the outside of the apparatus body 501. The duct 611 also has a cross-sectional shape that widens from the first space 601 toward the ventilation port 605.

Thus, the cross-sectional shape of each of the ventilation port 605 and the duct 611 widening toward the outside can effectively dissipate the internal heat to the outside.

Figure 15:
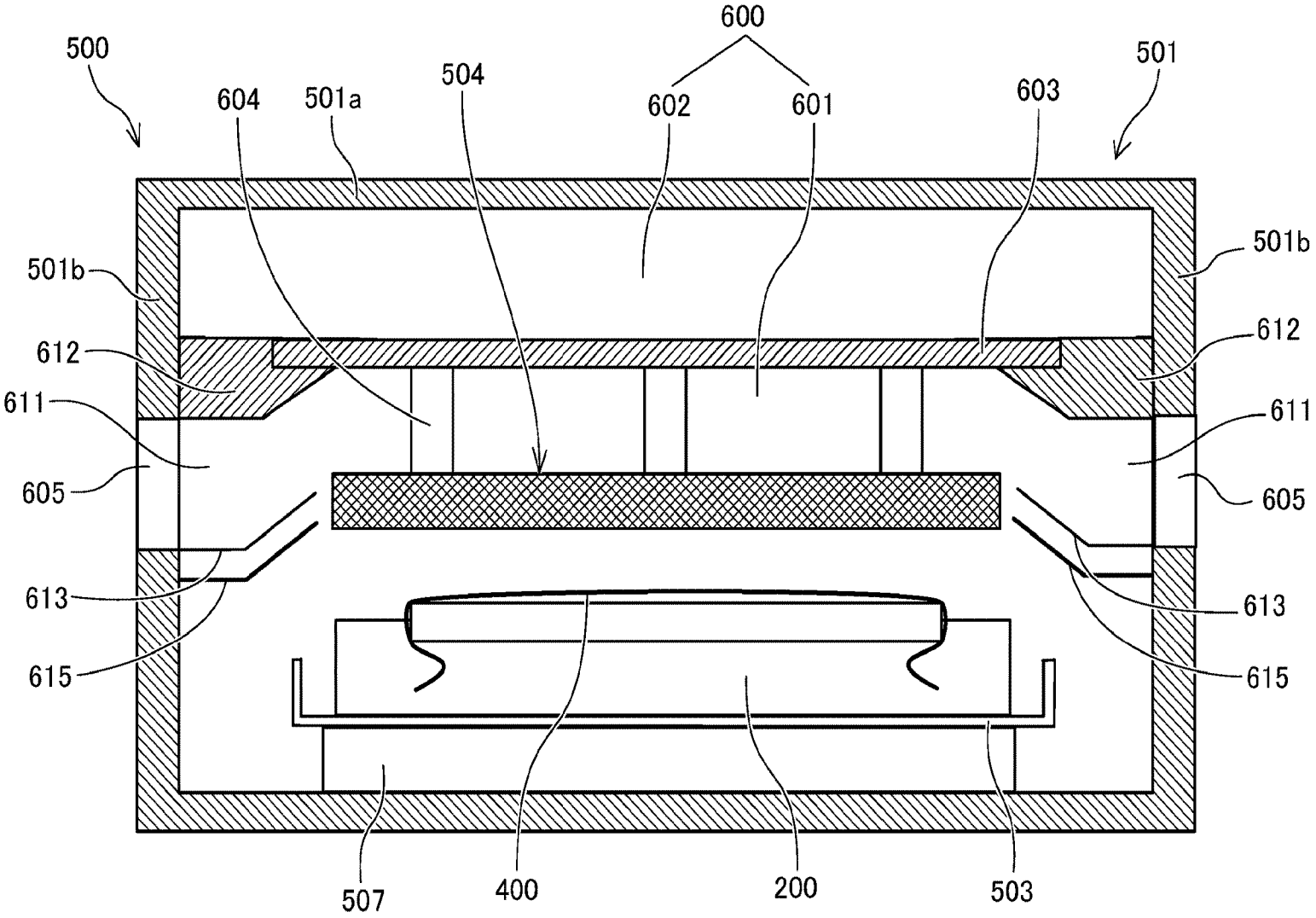
FIG. 15 is a schematic cross-sectional view of the heating apparatus according to a fourth embodiment of the present disclosure, cut along the short direction.

Next, the heating apparatus according to a fourth embodiment of the present disclosure is described with reference to FIG. 15. FIG. 15 is a schematic cross-sectional view of the heating apparatus cut along the short direction (direction perpendicular to the cassette insertion-and-removal directions).

In the present embodiment, in the configuration of the second embodiment (or another embodiment), a protective cover 615 is disposed on the receiver 503 side of the lower duct member 613 of the duct 611.

Thus, when the lower duct member 613 is formed of, e.g., a sheet metal, the heat transmitted to the lower duct member 613 can be prevented from further leaking to the receiver 503 side. The protective cover 615 is preferably made of a resin material from the viewpoint of thermal conductivity.

Figure 16:
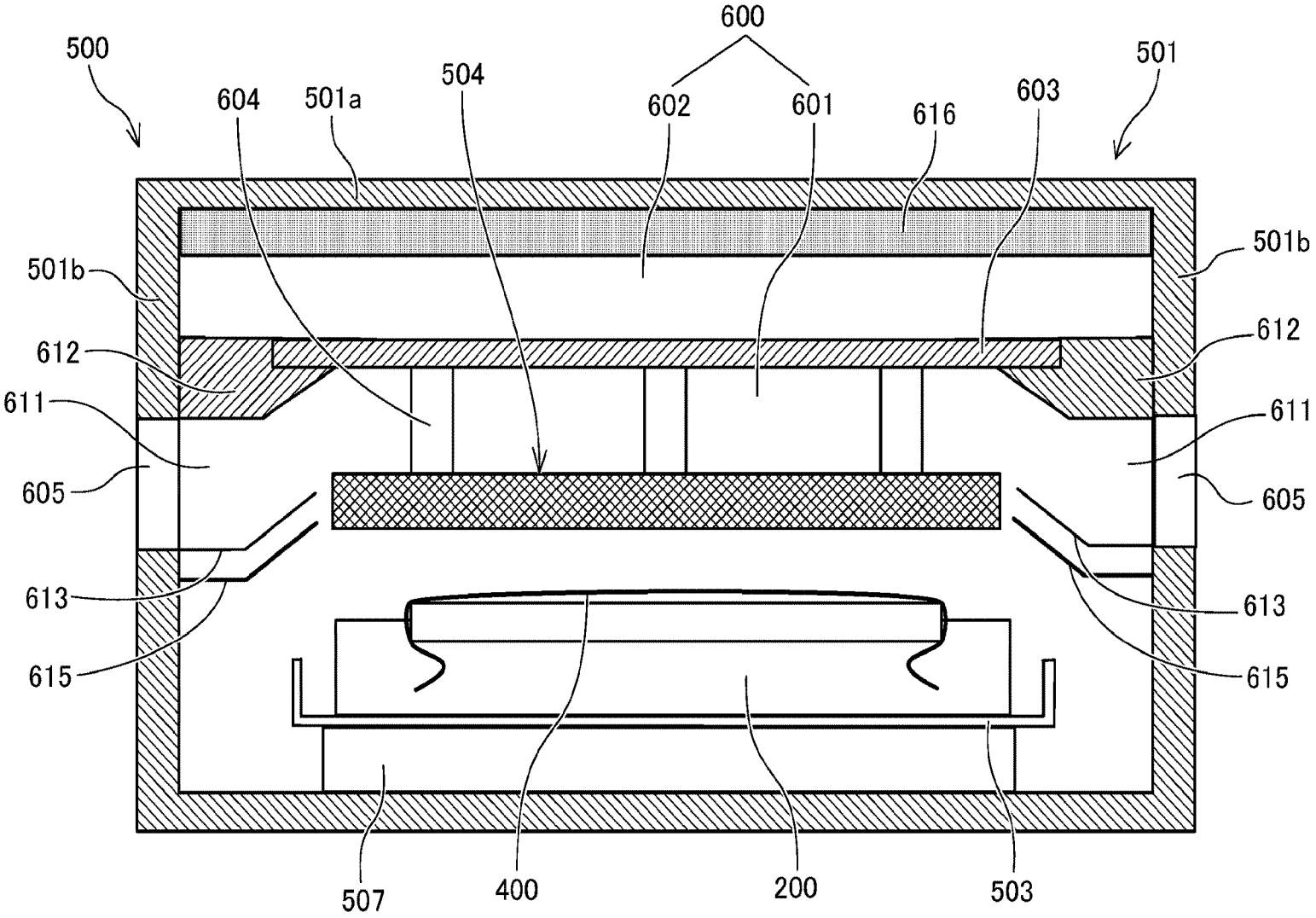
FIG. 16 is a schematic cross-sectional view of the heating apparatus according to a fifth embodiment of the present disclosure, cut along the short direction.

Next, the heating apparatus according to a fifth embodiment of the present disclosure is described with reference to FIG. 16. FIG. 16 is a schematic cross-sectional view of the heating apparatus cut along the short direction (direction perpendicular to the cassette insertion-and-removal directions).

In the present embodiment, in the configuration of the fourth embodiment (or another embodiment), a heat insulator 616 is disposed on the upper surface side of the second space 602, in this case, the inner surface side of the upper surface portion 501*a* of the apparatus body 501.

Such a configuration can suppress the temperature rise of the upper surface portion 501*a* of the apparatus body 501 even when the temperature of the second space 602 rises.

The shape of the "cloth holder" in an embodiment of the present disclosure is not limited to a box shape of, e.g., the cassette of the above-described embodiments if the cloth holder has a structure that can be attached to and detached from a printer, a heating apparatus, or a fixing device. For example, the cloth holder may be a single plate-shaped platen member that is insertable into the printer and the heating apparatus.

Further, for further enhancement of the workability, the cloth holder with a cloth (e.g., T-shirt) already set may be used to obviate the step of an operator's setting the cloth on a tray every time for printing. In such a case, the cloth holder is collected after use and the cloth holder with another cloth already set is supplied.

Alternatively, to attain similar advantages, a platen member, which is attachable to and detachable from the cloth holder, with a cloth (e.g., T-shirt) already set may be used. In the case of using the platen member with the already-set cloth, the platen member with the already-set cloth is directly mounted on the cloth holder. After completion of printing and fixing, the platen member is removed from the cloth holder. Then, another platen member with an already-set cloth is mounted on the cloth holder, and printing and fixing are performed on the already-set cloth. In such a case, the platen member is collected after use, and the platen member with another cloth already set is supplied.

Such a configuration can obviate an operator's setting of a cloth (e.g., T-shirt) every time, facilitate continuous processing of a plurality of clothes, and automate continuous processing of a plurality of clothes.

In the above-described embodiments, the case in which the cloth is a T-shirt or the like is described. However, the present disclosure can be similarly applied to a case in which an object to be heated is a medium including, for example, a cloth. In such a case, the cloth used in the above-described embodiments serves as the medium. Furthermore, the present disclosure can also be applied to a heating apparatus that heats heating target members, such as foods, other than clothes and media.

Numerous additional modifications and variations are possible in light of the above teachings. It is therefore to be understood that, within the scope of the above teachings, embodiments of the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating apparatus comprising:

an apparatus body;

a receiver to hold a heating target so that the heating target is insertable into and removable from the apparatus body;

a heating device disposed above the receiver, to heat the heating target; and a partition that partitions an upper space above the heating device into a first space facing the heating device and a second space facing an upper surface portion of the apparatus body, wherein the partition defines the upper space such that edges of the partition on opposite sides of the partition in a first direction contact surfaces that are perpendicular thereto, and other edges of the partition on other opposite sides of the partition in a second direction which is perpendicular to the first direction contact surfaces that are perpendicular thereto.

2. The heating apparatus according to claim 1, further comprising a ventilation path communicating the first space with an outside of the apparatus body.

3. The heating apparatus according to claim 2, wherein the ventilation path includes a ventilation port of the apparatus body and a duct connecting the ventilation port and the first space.

4. The heating apparatus according to claim 3, wherein the ventilation port has a cross-sectional shape that widens from an inside of the apparatus body toward the outside of the apparatus body.

5. The heating apparatus according to claim 3, wherein the duct has a cross-sectional shape that widens from the first space toward the ventilation port.

6. The heating apparatus according to claim 3, further comprising a protective cover between the duct and the receiver.

7. The heating apparatus according to claim 3, wherein at least a part of the duct is made of metal.

8. The heating apparatus according to claim 1, further comprising a heat insulator between the second space and the upper surface portion of the apparatus body.

9. The heating apparatus according to claim 1, wherein the partition is a heat shield or a heat insulator.

10. The heating apparatus according to claim 1, wherein the heating device is held by the partition.

11. The heating apparatus according to claim 1, wherein the heating target is a cloth.

12. The heating apparatus according claim 1, further comprising a cloth holder to removably hold the heating target, wherein the receiver holds the cloth holder so that the cloth holder is insertable into and removable from the apparatus body.

13. An image applier comprising:

a cloth holder to hold a cloth;

a printer to print an image on the cloth held by the cloth holder; and the heating apparatus according to claim 1 to heat the cloth on which the image has been printed by the printer, with the cloth being held by the cloth holder.

14. An image applying method comprising:

holding a cloth on a cloth holder;

printing an image on the cloth with the cloth being held by the cloth holder;

holding the cloth holder with the cloth being held by the cloth holder; and heating the cloth with the cloth holder being held on the receiver of the heating apparatus according to claim 1.

15. A heating apparatus comprising:

an apparatus body;

a receiver to hold a heating target so that the heating target is insertable into and removable from the apparatus body;

a heating device disposed above the receiver, to heat the heating target; and a partition that partitions an upper space above the heating device into a first space facing the heating device and a second space facing an upper surface portion of the apparatus body, wherein the partition defines the upper space such that the first space is separate from the second space, and air from the second space cannot directly pass from the second space to the first space.

16. The heating apparatus according to claim 15, further comprising a ventilation path communicating the first space with an outside of the apparatus body.

17. The heating apparatus according to claim 16, wherein the ventilation path includes a ventilation port of the apparatus body and a duct connecting the ventilation port and the first space.

18. The heating apparatus according to claim 17, wherein the ventilation port has a cross-sectional shape that widens from an inside of the apparatus body toward the outside of the apparatus body.

19. The heating apparatus according to claim 17, wherein the duct has a cross-sectional shape that widens from the first space toward the ventilation port.

20. The heating apparatus according to claim 17, further comprising a protective cover between the duct and the receiver.

* * * * *